United States Patent [19]

Feuersanger et al.

[11] 4,287,454

[45] Sep. 1, 1981

[54] HIGH PRESSURE DISCHARGE LAMPS WITH FAST RESTART

[75] Inventors: Alfred E. Feuersanger, Framingham; Leslie A. Riseberg, Sudbury; William H. McNeill, Carlisle, all of Mass.

[73] Assignee: GTE Laboratories Incorporated, Waltham, Mass.

[21] Appl. No.: 104,334

[22] Filed: Dec. 17, 1979

[51] Int. Cl.[3] ..... H05B 35/00; H05B 37/00; H05B 39/00; H05B 41/00

[52] U.S. Cl. ..... 315/178; 315/35; 315/48; 315/183; 315/46; 315/185 R

[58] Field of Search ..... 315/35, 46, 47, 48, 315/119, 125, 122, 178, 182, 248, 123, 167, 121, 185

[56] References Cited

U.S. PATENT DOCUMENTS

| | | | |
|---|---|---|---|
| 966,204 | 8/1910 | Hewitt | 315/248 |
| 1,033,275 | 7/1912 | Schaffer | 315/182 |
| 2,017,719 | 10/1935 | Inman | 315/182 X |
| 2,043,023 | 6/1936 | Westendorp | 315/182 X |
| 2,076,278 | 4/1937 | Ryde et al. | 315/183 X |
| 2,297,258 | 9/1942 | Spanner | 315/182 |
| 2,691,746 | 10/1954 | Zwikker | 315/121 X |
| 2,878,422 | 3/1959 | Stoelting | 315/125 X |
| 3,187,221 | 6/1965 | Walsh | 315/182 |

*Primary Examiner*—Saxfield Chatmon, Jr.
*Attorney, Agent, or Firm*—William R. McClellan

[57] ABSTRACT

A light source including two high intensity discharge devices, such as metal vapor discharge tubes, electrically coupled in parallel to provide fast restart and immediate illumination after a momentary power interruption. Upon application of power, one of the discharge devices starts and operates while the other discharge device remains below its maximum starting temperature and in readiness for immediate restart. The discharge devices can be enclosed by a common outer envelope. The discharge devices can alternatively be high pressure electrodeless lamps coupled in parallel to provide fast restart.

16 Claims, 4 Drawing Figures

HIGH PRESSURE DISCHARGE LAMPS WITH FAST RESTART

BACKGROUND OF THE INVENTION

This invention relates to high pressure discharge lamps and, more particularly, to light sources wherein the restart time after a momentary power interruption is reduced.

High pressure discharge lamps, such as high pressure sodium, high pressure mercury vapor, and metal halide lamps, provide significantly higher efficiencies than incandescent lamps and are widely used for general lighting purposes. An inherent disadvantage of high pressure discharge lamps is the warm-up period of several minutes during which only a low level of illumination is available. By comparison, incandescent and fluorescent lamps provide full light output in a few seconds or less. The warm-up period or cold-start delay associated with high pressure discharge lamps is due to the necessity for the fill material to be vaporized and the discharge tube to be warmed up before full light output is attained. Furthermore, when power to the lamp is momentarily interrupted, the discharge is extinguished and cannot be re-initiated until the lamp cools off and the pressure in the lamp is reduced. After the discharge is re-ignited, the warm-up period described above must be repeated before the lamp again reaches full light output. The hot restart delay is thus longer than the cold-start delay.

The hot restart delay associated with high pressure discharge lamps is unacceptable in many applications. When high pressure discharge lamps are used in conjunction with heavy electrical equipment, for example, in mines, the equipment can generate power line transients which extinguish the discharge lamps and illumination is lost for several minutes. Temporary power outages and transients from other sources can also cause a loss of illumination from high pressure discharge lamps for several minutes.

It is known to use standby incandescent filaments to provide illumination during the hot restart delay period associated with high pressure discharge lamps. However, additional circuitry is required to energize the incandescent filaments at the proper time. Hot discharge lamps can be restarted by applying a high voltage for a short time. However, additional circuitry is required to apply high voltage to the discharge lamp at the proper time.

While the hot restart delay of high pressure discharge lamps has been discussed in connection with electroded discharge lamps, hot restart delays also occur in high pressure electrodeless lamps powered by high frequency power. Electrodeless lamps can be greatly improved by a reduction or elimination of the hot restart delay associated therewith.

SUMMARY OF THE INVENTION

It is therefore an object of the present invention to provide high pressure discharge apparatus with fast restart characteristics.

Another object of the present invention is to provide high pressure discharge apparatus with increased operating lifetimes.

According to the present invention, these and other objects and advantages are achieved in electromagnetic discharge apparatus comprising a plurality of high intensity discharge means electrically coupled so that substantially the same voltage is applied to all of the discharge means. The discharge means have the characteristic that discharge cannot be initiated therein by a normal starting voltage when the discharge means is above a predetermined temperature. The discharge means have sufficient thermal isolation therebetween that, when a discharge, previously established in one of the discharge means, is extinguished, at least one other of the discharge means is below the predetermined temperature. Discharge is initiated in one of the plurality of discharge means substantially immediately upon application of the normal starting voltage after the previously established discharge is extinguished.

For a better understanding of the present invention, together with other and further objects, advantages and capabilities thereof, reference is made to the following disclosure and appended claims in connection with the above-described drawings.

DETAILED DESCRIPTION OF THE INVENTION

Figure 1:
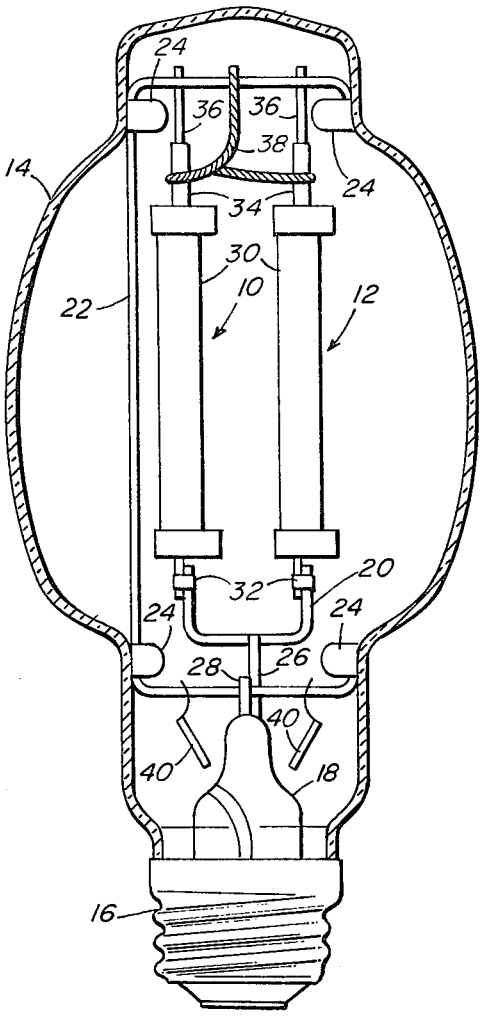
FIG. 1 depicts a high intensity discharge lamp with two arc tubes in a side-by-side configuration in accordance with the present invention.

According to the present invention, electromagnetic discharge apparatus includes two or more high intensity discharge devices electrically coupled so that substantially the same voltage is applied to all of the discharge devices. A preferred embodiment of the present invention is shown in FIG. 1. A light source includes two high intensity discharge tubes 10 and 12, arranged side-by-side and parallel to each other and is typically enclosed by an outer envelope 14. The outer envelope 14 is evacuated in the case of high pressure sodium discharge tubes and is made of a light transmitting substance. The envelope 14 can contain an inert gas when other types of discharge tubes are used. The envelope 14 can have a phosphor coating on its inner surface depending on the discharge tube fill material and the desired output light spectrum. A two conductor screw type base 16 is operative to receive power from an external source and to couple power through a lamp stem 18.

The discharge tubes 10 and 12 are supported in the envelope 14 by a U-shaped lower support frame 20 and an upper support frame 22. The support frames 20 and 22 are made of conductive material and are operative not only to support the discharge tubes 10 and 12, but also to conduct power from the base 16 to the discharge tubes 10 and 12. The discharge tubes 10 and 12 are shown in FIG. 1 as being connected electrically in parallel, thus insuring that the same voltage is applied to both discharge tubes 10 and 12. However, it is to be understood that various electrical components can be connected in series with the discharge tubes 10 and 12 without departing from the scope of the present invention provided that substantially the same voltage is applied to the discharge tubes 10 and 12. The upper support frame 22 is generally C-shaped and includes resilient tabs 24 which bear against opposite sides of the outer envelope 14 at its top and bottom and position the support frame 22 in the envelope 14. The support frames 20 and 22 are coupled through the lamp stem 18 to the base 16 by conductive members 26 and 28, respectively.

The discharge tubes 10 and 12, shown as high pressure sodium discharge tubes, include cylindrical tubes 30 commonly made of a ceramic light-transmitting material such as alumina or yttria and have electrodes sealed in opposite ends by known methods. At the lower ends of the discharge tubes 10 and 12, the electrodes are typically coupled to the lower support frame 20 by conductive straps 32. Electrodes 34 at the upper ends of the discharge tubes 10 and 12 have the configuration of hollow cylinders into which centering rods 36 are inserted. The centering rods 36 are firmly coupled to the support frame 22, such as by spotwelding, but are free to slide in or out of the electrodes 34. Thus, when the discharge tubes 10 and 12 expand during high temperature operation, the support structure is not strained or distorted. A flexible lead wire 38 provides electrical contact between the support frame 22 and the electrodes 34 of the discharge tubes 10 and 12. The discharge tubes 10 and 12 are spaced apart by the support frames 20 and 22 so that there is at least some thermal isolation between tubes as will be discussed more fully hereinafter. Getters 40, which may be based on barium coatings, are spotwelded to the support frame 22. The barium, after flashing onto the inner surface of the envelope 14, is operative to absorb any material outgassed by the discharge tubes 10 and 12. The use of such getters in high intensity discharge light sources is known.

While the discharge tubes 10 and 12 can be any high intensity discharge tubes, the configuration shown is typical of high pressure sodium discharge tubes. The discharge tubes 10 and 12 have a fill material including an amalgam of sodium and mercury and an inert gas in the case of high pressure sodium lamps. The discharge tubes 10 and 12 shown in FIG. 1 can alternatively be high pressure mercury vapor discharge tubes or metal halide discharge tubes and the necessary changes to the support frames 20 and 22 are obvious to those skilled in the art. All of these discharge tubes are difficult to start when in a high temperature, high pressure condition.

High intensity discharge lamps are typically operated from a lamp ballast circuit which utilizes 60 Hz line voltage to provide starting voltage and to sustain the proper voltage for operation of the discharge lamps. Lamp ballasts typically include a transformer to provide an inductive source, a capacitor for power factor correction and an ignitor for providing starting pulses. Lamp ballasts commonly used with standard high intensity discharge lamps can be used in conjunction with the light source of the present invention.

While high intensity discharge devices are typically operated from 60 Hz power conditioned by a lamp ballast circuit, it is known that such discharge devices can be operated from dc power or from other ac frequencies. The dual discharge tube configuration of the present invention can also be operated from dc power or from other ac frequencies.

In operation, the starting voltage is applied to the discharge tubes 10 and 12. Because of the statistical variation in parameters between the tubes, one of the tubes will have a tendency to start, that is, initiate discharge, first. When one of the discharge tubes starts, the impedance of the tube drops from a very high value to a fairly low value. The drop in impedance of the lamp that started causes a significant drop in the voltage applied to both lamps due to the source resistance of the lamp ballast and there is insufficient voltage to start the second lamp. The discharge tube that initially started thus warms up and the discharge therein increases in intensity until full output is reached while the other lamp remains off. The light source continues to operate in this mode as long as power is continuously supplied. Since the non-operating discharge tube continues to have a very high impedance, negligible input power is dissipated by it.

Assume for purposes of discussion that the discharge tube 10 has been started and is in operation and that the discharge tube 12 is off. A momentary interruption of power supplied to the light source extinguishes the discharge in the tube 10. When the power is re-applied, a high voltage appears across both discharge tubes since the discharge load is no longer present. The discharge tube 10 is too high in pressure and temperature for immediate restarting. However, the previously idle discharge tube 12 is relatively low in temperature and pressure and starts immediately. The discharge in tube 12 increases in intensity until full output is reached while the discharge tube 10 cools down and is ready for fast restart in the event that the discharge in the tube 12 is extinguished. Thus, according to the present invention, one of the discharge tubes operates while the other is held in readiness for immediate restart.

Whether or not the power is interrupted, the present invention is useful in the event that one of the discharge tubes fails. The discharge load in the discharge tube which failed is no longer present, the applied voltage increases and the previously idle discharge tube starts.

As stated hereinabove, the amount of thermal coupling between the discharge tubes 10 and 12 is of importance in the operation of the light source of FIG. 1. A high intensity discharge device cannot be restarted by the normal open circuit voltage of the power source when the device is above a predetermined maximum starting temperature, typically about 200° C. The normal discharge tube operating temperature is typically about 750° C. for high pressure mercury vapor lamps and metal halide lamps and is about 1200° C. for high pressure sodium lamps. In order to insure immediate starting of the previously non-operating discharge tube, the light source must have sufficient thermal isolation between discharge tubes to maintain the non-operating discharge tube below its maximum starting temperature when the operating discharge tube is hot. The thermal isolation depends on the spacing of the discharge tubes, whether or not the envelope 14 is evacuated, and the thermal conductivity of the discharge tube support structure. For the configuration shown in FIG. 1, it has been found that a center-to-center spacing of 1.125 inches between the discharge tubes 10 and 12 is sufficient for evacuated high pressure sodium lamps to insure immediate starting of the light source after a temporary power outage.

While the light source of the present invention restarts immediately upon re-application of power, it produces less than full light output at that time. The discharge tube warms up and the discharge therein increases in intensity until full output is reached. The restart time can be defined as the time interval between the re-application of power and the time when 90% of full light output is restored. The restart time can be reduced when there is sufficient thermal coupling between the discharge tubes 10 and 12 to preheat the non-operating discharge tube. The preheated discharge tube requires less time to reach normal operating temperature than a discharge tube starting from ambient temperature. Also, due to the elevated fill pressure, the light source provides higher light output at restart. Alternatively, the discharge tubes 10 and 12 can be completely isolated thermally, but the restart time improvement of the invention is somewhat reduced. When 70 watt high pressure sodium discharge tubes are used in the configuration shown in FIG. 1, the restart time is about 50% of that observed in a single discharge tube configuration. The light source of FIG. 1 produces light immediately after re-application of power, whereas the single discharge tube configuration exhibits complete loss of illumination until the discharge lamp cools to the predetermined temperature at which it can be restarted. Thus, the present invention is characterized not only by a reduced restarting time but also by a maintenance of lighting after a power transient or a momentary power outage.

"Glow hang-up" is a known problem with single discharge tube metal halide lamps. When voltage is reapplied to a hot metal halide lamp after a momentary power outage, the lamp goes into a glow state and ion bombardment of the electrodes causes tungsten deposition from the electrodes on the quartz discharge tube rendering it black and thereby reducing the light output from the lamp. To avoid this problem, it is advised to turn the lamp power off for 15 to 20 minutes after a momentary power outage. "Glow hang-up" is avoided in the dual discharge tube configuration of the present invention since the immediate starting of the previously non-operating discharge tube greatly reduces the voltage applied to both discharge tubes. Furthermore, when metal halide discharge tubes are utilized in the configuration of FIG. 1, the restart time is approximately 3 minutes, which is 20% of the restart time for a standard single discharge tube configuration.

The lifetime of the light source of FIG. 1 is increased significantly over that of the single discharge tube configuration. Referring now to FIG. 1, assume that initially the discharge tube 10 starts when power is applied because of a lower starting threshold. As the discharge tube 10 ages, its starting threshold increases. Since the discharge tube 12 initially remains off, its starting threshold remains approximately constant. When the starting threshold of the discharge tube 10 exceeds that of the discharge tube 12 because of aging effects, the discharge tube 12 will start when power is applied. It can be seen that as the light source ages, the discharge tubes 10 and 12 alternate in operation and each tube ages equally, thus significantly increasing the overall lifetime of the light source relative to the single discharge tube configuration. Lifetime can be further improved relative to the single discharge tube configuration by utilizing multiple discharge tubes electrically connected in parallel in the light source of FIG. 1.

Figure 2:
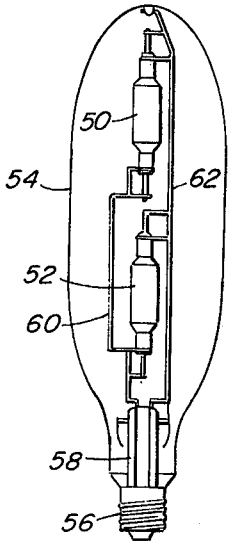
FIG. 2 depicts a high intensity discharge lamp with two arc tubes in a collinear configuration in accordance with the present invention.

One of the effects of utilizing a dual discharge tube configuration as shown in FIG. 1 is that one discharge tube blocks or shades a portion of the light produced by the other discharge tube. When an isotropic radiation pattern is necessary, the shading effect can be reduced or eliminated by varying the physical relation between the discharge tubes. A preferred embodiment of the present invention which eliminates the shading effect is illustrated in FIG. 2. A light source includes two high intensity discharge tubes 50 and 52 enclosed by a light transmitting outer envelope 54. The envelope 54 can have a phosphor coating on its inner surface depending on the discharge tube fill material and the desired output light spectrum. A screw type base 56 is operative to receive power from an external source and to couple power through a lamp stem 58. The discharge tubes 50 and 52 are supported in the envelope 54 by a lower support frame 60 and an upper support frame 62. The support frames 60 and 62 are made of conductive material and are operative not only to support the discharge tubes 50 and 52, but also to conduct power from the base 56 to the discharge tubes 50 and 52 which are electrically connected in parallel.

The operation of the light source of FIG. 2 is the same as that of the light source of FIG. 1. That is, one of the discharge tubes 50 and 52 starts and operates upon application of power while the other of the discharge tubes remains off and in readiness for immediate starting after a power transient or a temporary power outage. An important feature of the light source of FIG. 2 is that the discharge tubes 50 and 52 are in collinear arrangement and light emitted by one of the discharge tubes 50 and 52 is not shaded by the other of the discharge tubes except at the ends of the discharge tubes where there is little or no light emission. Another advantage is that the thermal isolation between discharge tubes is greater in the collinear configuration than in the parallel side-by-side configuration. This feature is important when a thin lamp envelope is necessary and there is insufficient space for a side-by-side configuration with adequate thermal isolation. The advantages of the parallel connected, dual discharge tube configuration, discussed hereinabove in connection with FIG. 1, are present in the light source of FIG. 2. These advantages are fast restart and improved lifetime as compared with the single discharge tube configuration.

The discharge tubes 50 and 52 in FIG. 2 are shown as metal halide discharge tubes which typically are made of quartz and utilize a fill material including mercury, metal halides such as iodides of sodium and scandium, and a buffer gas such as argon. Other fill materials are known. The discharge tubes 50 and 52 shown in FIG. 2 can alternatively be high pressure sodium discharge tubes or high pressure mercury vapor discharge tubes and the necessary changes to the support frames 60 and 62 are obvious to those skilled in the art.

Figure 3:
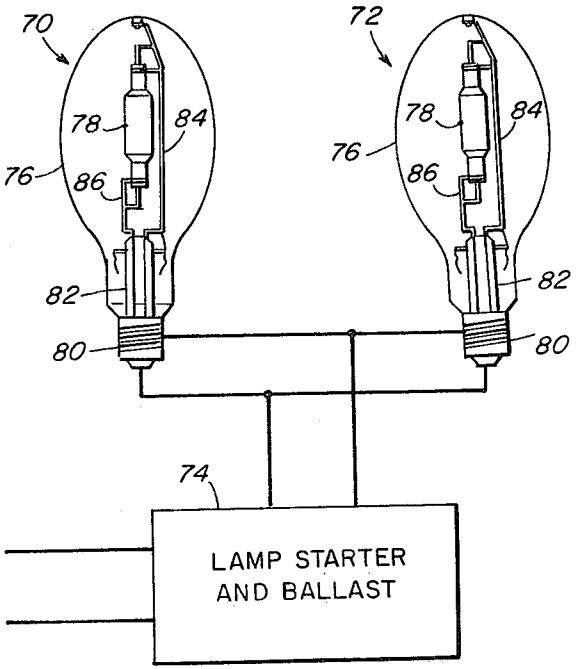
FIG. 3 depicts a light source wherein two high intensity discharge lamps are coupled in parallel to the output of a ballast in accordance with the present invention.

As discussed hereinabove, thermal coupling between the dual discharge tubes of the present invention is preferred but is not necessary. A preferred embodiment of the present invention utilizing high intensity discharge lamps 70 and 72 coupled in parallel to a lamp starter and ballast 74 is shown in FIG. 3. Each of the discharge lamps 70 and 72 includes an outer envelope 76 enclosing a high intensity discharge tube 78. The discharge tubes 78 are illustrated in FIG. 3 as metal halide discharge tubes, but can alternatively be high pressure sodium or high pressure mercury vapor discharge tubes. The envelope 76 can have a phosphor coating on its inner surface. External power is received by a lamp base 80 and coupled through a lamp stem 82 and an upper support frame 84 and a lower support frame 86 to the discharge tube 78. The lamp starter and ballast 74, which typically receives input power at 60 Hz, has its output coupled to the lamp base 80 of the discharge lamps 70 and 72. Suitable lamp starter and ballast 74 circuits are known and can supply ac or dc power to the discharge lamps 70 and 72. The lamp starter and ballast 74 is chosen to satisfy the starting and operating requirements of the discharge lamps 70 and 72.

The operation of the light source of FIG. 3 is the same as that of the light source of FIG. 1. That is, one of the discharge lamps 70 and 72 starts and operates upon application of power while the other of the discharge tubes remains off and in readiness for immediate starting after a power transient or a temporary power outage. Thus, the light source of FIG. 3 exhibits fast restart characteristics. This arrangement has the advantage that fast restart can be obtained by connection of existing, commercially available high intensity discharge lamps.

Figure 4:
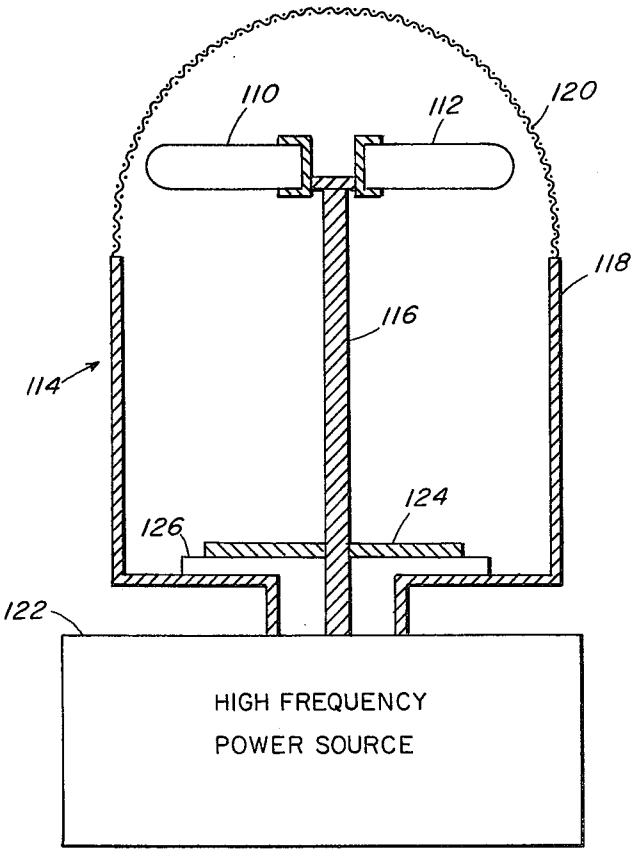
FIG. 4 depicts an electrodeless light source utilizing two electrodeless lamps in accordance with the present invention.

A preferred embodiment of the present invention utilizing high pressure electrodeless lamps is shown in FIG. 4. An electrodeless light source includes electrodeless lamps 110 and 112 and means for excitation of the lamp fill material, illustrated as a termination fixture 114. The termination fixture typically includes a transmission line adapted for delivery high frequency power to a discharge with the electrodeless lamps 110 and 112 acting as termination loads. The excitation means is coupled to the electrodeless lamps 110 and 112. The electrodeless lamps 110 and 112 have an envelope made of a transparent substance such as quartz. The lamp envelope encloses a fill material which emits light upon breakdown and excitation by a high frequency power source. The termination fixture 114 includes an inner conductor 116 and an outer conductor 118 disposed around the inner conductor 116. At least a portion of the outer conductor 118 is optionally transparent and can be a conductive mesh 120 as shown in FIG. 4. The electrodeless lamps 110 and 112 are mounted at the second end of the inner conductor 116 so that a high frequency voltage applied to the termination fixture 114 is applied simultaneously to the electrodeless lamps 110 and 112. The electrodeless lamps 110 and 112 cannot be restarted by the normal open circuit voltage of the high frequency power source 122 when the lamp is above a predetermined maximum starting temperature, typically about 200° C. The normal operating temperature of an electrodeless lamp is typically about 750° C. In order to insure immediate starting of one of the electrodeless lamps, the light source must have sufficient thermal isolation between electrodeless lamps to maintain the non-operating electrodeless lamp below its maximum starting temperature when the operating electrodeless lamp is hot.

The first end of each conductor can be connected to a high frequency power source 122. The frequency of the power source 122 is in the range from 100 MHz to 300 GHz and is preferably in the ISM (Instrument, Scientific and Medical) band from 902 MHz to 928 MHz. Details of the construction of electrodeless light sources have been shown in U.S. Pat. No. 3,942,058 issued Mar. 2, 1976 to Haugsjaa et al. A high frequency power source is described in U.S. Pat. No. 4,070,603 issued Jan. 24, 1978 to Regan et al. The termination fixture 114 includes a conductor 124 adjustably mounted near the first end of the inner conductor 116 and separated from the outer conductor 118 by a dielectric spacer 126. The conductor 124 operates to match the impedance of the electrodeless lamps 110 and 112 to the power source 122 as described in U.S. Pat. No. 3,943,403 issued Mar. 9, 1976 to Haugsjaa et al. The fill material in the electrodeless lamps 110 and 112 is typically mercury and a noble gas such as argon or a combination of mercury, metal halides, and a noble gas. Starting of the lamps is assisted by illumination of the lamps with ultraviolet radiation or by the inclusion in the lamp envelope of a small quantity of krypton 85.

The starting and restarting operation of the light source of FIG. 4 is the same in principle as that of the light source of FIG. 1. When high frequency power is applied to the termination fixture 114, a discharge starts in the one of the electrodeless lamps 110 and 112 with the lower starting threshold. The electrodeless lamp which started warms up and the discharge therein increases in intensity. When one of the electrodeless lamps starts, it drops significantly in impedance. The loading effect of the operating lamp decreases the high frequency voltage applied to both electrodeless lamps and the non-operating lamp cannot start. When the operating lamp reaches equilibrium, it is in a high temperature (typically 750° C.), high pressure (typically 6 atm) condition. Thus, when a momentary power failure occurs and the discharge in the operating electrodeless lamp is extinguished, it is hot and must cool for several minutes before it can be restarted. However, the previously non-operating electrodeless lamp is relatively low in pressure and temperature and starts immediately. Thus, according to the present invention, one of the electrodeless lamps operates while the other is held in readiness for immediate restart.

The electrodeless light source shown in FIG. 4 was found to exhibit a restart time about 10% that of an electrodeless light source with one electrodeless lamp. Furthermore, light is produced at a reduced level immediately after power is re-applied following a power transient or momentary power outage. The restart time of the electrodeless light source of FIG. 4 can be further reduced by permitting sufficient thermal coupling between the electrodeless lamps 110 and 112 to preheat the non-operating electrodeless lamp to a temperature below its maximum starting temperature, as described hereinabove in connection with FIG. 1. The electrodeless light source shown in FIG. 4 exhibits increased lifetime in comparison with a single lamp electrodeless light source for reasons discussed hereinabove in connection with FIG. 1.

While there has been shown and described what is at present considered the preferred embodiments of the invention, it will be obvious to those skilled in the art that various changes and modifications may be made therein without departing from the scope of the invention as defined by the appended claims.

What is claimed is:

1. Electromagnetic discharge apparatus comprising:

a plurality of high intensity discharge means adapted for coupling to a source of starting and operating voltage and electrically coupled so that substantially the same voltage is applied to all of said discharge means, said discharge means having the characteristic that discharge cannot be initiated therein by a normal starting voltage when said discharge means is above a predetermined temperature, said discharge means having sufficient thermal isolation therebetween that, when a discharge, previously established in one of said discharge means, is extinguished, at least one other of said discharge means is below said predetermined temperature, whereby discharge is initiated in one other of said plurality of discharge means substantially immediately after said previously established discharge is extinguished and said discharge means having sufficient thermal coupling therebetween that, when said one discharge means is hot, said other discharge means is preheated to a temperature below said predetermined temperature, whereby said other discharge means requires less time after initiation of discharge to reach full output than when said other discharge means is not preheated.

2. Discharge apparatus as defined in claim 1 wherein each of said plurality of high intensity discharge means includes a metal vapor discharge tube having electrodes sealed therein at opposite ends and containing a fill material which emits light during discharge.

3. Discharge apparatus as defined in claim 2 wherein said metal vapor discharge tubes are substantially parallel to each other.

4. Discharge apparatus as defined in claim 2 wherein said metal vapor discharge tubes are arranged such that light emitted by one of said discharge tubes is not substantially blocked by the other of said discharge tubes.

5. Discharge apparatus as defined in claim 4 wherein said metal vapor discharge tubes are arranged in a collinear configuration.

6. Discharge apparatus as defined in claim 1 wherein each of said plurality of high intensity discharge means includes an electrodeless lamp having a lamp envelope made of a light transmitting substance, said envelope enclosing a fill material which emits light during electromagnetic discharge, and said apparatus further comprises means for delivering high frequency power to said plurality of electrodeless lamps for sustaining discharge therein.

7. Discharge apparatus as defined in claim 6 wherein said means for delivering high frequency power includes transmission line means having a first end for receiving high frequency power and a second end coupled to each of said electrodeless lamps so that said lamps form a termination load for high frequency power propagating along said transmission line means.

8. Discharge apparatus as defined in claim 7 further including high frequency power means coupled to the first end of said transmission line means.

9. Discharge apparatus as defined in claim 8 wherein said transmission line means includes a termination fixture having an inner conductor and an outer conductor disposed around the inner conductor.

10. A light source comprising:

two high pressure metal vapor discharge tubes, each of said discharge tubes having electrodes sealed therein at opposite ends and containing a fill material which emits light during discharge;

an outer envelope made of a light transmitting substance, said envelope enclosing said discharge tubes; and means for coupling starting and operating voltages through said envelope to said discharge tubes, which are electrically coupled so that substantially the same voltage is applied to said discharge tubes, said discharge tubes having sufficient thermal isolation therebetween that, when a discharge, previously established in one of said discharge tubes, is extinguished, the other of said discharge tubes is below a predetermined maximum starting temperature, whereby discharge is initiated in said other of said discharge tubes substantially immediately after said previously established discharge is extinguished and said discharge tubes having sufficient thermal coupling therebetween that, when said one discharge tube is hot, said other discharge tube is preheated to a temperature below said maximum starting temperature, whereby said other discharge tube requires less time after starting to reach full light output than when said other discharge tube is not preheated.

11. The light source as defined in claim 10 wherein said metal vapor discharge tubes are substantially parallel to each other.

12. The light source as defined in claim 10 wherein said metal vapor discharge tubes are arranged in said outer envelope such that light emitted by one of said discharge tubes is not substantially blocked by the other of said discharge tubes.

13. The light source as defined in claim 12 wherein said metal vapor discharge tubes are arranged in a collinear configuration.

14. The light source as defined in claim 10 wherein each of said metal vapor discharge tubes is a high pressure sodium arc tube.

15. The light source as defined in claim 10 wherein each of said metal vapor discharge tubes is a high pressure mercury vapor arc tube and wherein said outer envelope includes an inner surface with a phosphor coating thereon.

16. The light source as defined in claim 10 wherein each of said metal vapor discharge tubes is a metal halide arc tube.

* * * * *